US008887597B2

(12) United States Patent
Black

(10) Patent No.: US 8,887,597 B2
(45) Date of Patent: Nov. 18, 2014

(54) SPLIT GRIP CONTROL LEVER FOR HEAVY MACHINERY

(75) Inventor: Phillip John Black, McConnellsburg, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 2701 days.

(21) Appl. No.: 11/250,612

(22) Filed: Oct. 17, 2005

(65) Prior Publication Data

US 2006/0053927 A1 Mar. 16, 2006

Related U.S. Application Data

(63) Continuation-in-part of application No. 09/842,028, filed on Apr. 26, 2001, now abandoned.

(51) Int. Cl.

| | |
|---|---|
| ***G05G 9/047*** | (2006.01) |
| ***G05G 5/00*** | (2006.01) |
| ***E02F 9/20*** | (2006.01) |
| ***G05G 1/06*** | (2006.01) |
| ***G05G 1/10*** | (2006.01) |

(52) U.S. Cl.

CPC ..... *G05G 5/005* (2013.01); *E02F 9/2004* (2013.01); *G05G 1/06* (2013.01); *G05G 1/10* (2013.01); *G05G 9/047* (2013.01)

USPC ..... 74/523; 74/471 XY

(58) Field of Classification Search

USPC ..... 74/471 XY, 491, 523, 544; 180/333–336; 200/6 A; 244/234, 236; 345/161; 463/38

See application file for complete search history.

(56) References Cited

U.S. PATENT DOCUMENTS

| | | | | | |
|---|---|---|---|---|---|
| 3,335,240 | A | * | 8/1967 | Dhaens et al. | 200/407 |
| 4,348,556 | A | * | 9/1982 | Gettig et al. | 200/5 R |
| 4,574,651 | A | | 3/1986 | Nordström | |
| 4,604,502 | A | * | 8/1986 | Thomas | 200/6 A |
| 4,654,647 | A | * | 3/1987 | Wedam | 345/160 |
| 5,042,314 | A | | 8/1991 | Rytter et al. | |
| 5,127,284 | A | | 7/1992 | Jorgensen | |
| 5,234,066 | A | * | 8/1993 | Ahsing et al. | 180/6.5 |
| 5,350,891 | A | | 9/1994 | Ditzig | |
| 5,409,074 | A | * | 4/1995 | Wilson et al. | 180/6.5 |
| 5,472,156 | A | | 12/1995 | Bivens et al. | |
| 5,533,590 | A | | 7/1996 | Steffen et al. | |
| 5,577,417 | A | | 11/1996 | Fournier | |
| 5,589,854 | A | | 12/1996 | Tsai | |
| 5,648,798 | A | * | 7/1997 | Hamling | 345/163 |
| 5,675,359 | A | | 10/1997 | Anderson | |
| 5,767,840 | A | | 6/1998 | Selker | |
| 5,768,947 | A | | 6/1998 | Fee et al. | |
| 5,769,363 | A | | 6/1998 | Griswold et al. | |
| 5,938,282 | A | * | 8/1999 | Epple | 297/217.3 |
| 6,029,535 | A | | 2/2000 | Kenny et al. | |

(Continued)

*Primary Examiner* — Thomas Diaz

(74) *Attorney, Agent, or Firm* — Nixon & Vanderhye P.C.

(57) ABSTRACT

A split grip control lever is suitable for operating heavy machinery and includes a fixed base portion that provides secure operator support during operation of the machine. A movable upper portion is pivotable relative to the fixed base portion by the user's thumb and index finger to control operation of machine components. The movable upper portion and the fixed base portion preferably define a substantially continuous profile. Additionally, a control device is placed inside the fixed base portion of the grip, allowing for a shorter control shaft that pivots at or near the center of the unit. This arrangement facilitates control of the equipment.

19 Claims, 2 Drawing Sheets

(56) References Cited

U.S. PATENT DOCUMENTS 6,148,593 A 11/2000 Heinsey et al.
6,152,676 A 11/2000 Evert et al.
6,222,526 B1 * 4/2001 Holmes ..... 345/161
6,501,198 B2 12/2002 Taylor et al.

* cited by examiner

SPLIT GRIP CONTROL LEVER FOR HEAVY MACHINERY

CROSS-REFERENCES TO RELATED APPLICATIONS

This application is a continuation-in-part of (CIP) of U.S. patent application Ser. No. 09/842,028, filed Apr. 26, 2001 now abandoned, the entire content of which is herein incorporated by reference.

STATEMENT REGARDING FEDERALLY SPONSORED RESEARCH OR DEVELOPMENT (NOT APPLICABLE)

BACKGROUND AND SUMMARY OF THE INVENTION

The present invention relates to a control lever for heavy machinery and, more particularly, to a control lever including a fixed grip portion to help support an operator while driving or maneuvering the machinery, while reducing the potential for inadvertent motion of the control during operation.

Many types of equipment place an operator in a position where the operator moves with an arm or other device attached to the machine. The operator may be standing or sitting while maneuvering the equipment. As such, from this position, the operator must attempt to counteract the inertia forces associated with motion and operation of the machinery.

Because of these forces, it is desirable for manufacturers to provide a fixed grip for the operator that also contains the controls necessary to move or position parts of the equipment. Such a design would help address issues associated with operator comfort, safety and support while operating the equipment.

Current joy stick and control designs do not address the sudden inertia shifts which may or may not occur as a result of the operator's decision to activate or cease activation of a moving function of the machine to which the operator is part of the movement. In addition, current designs force the operator to grasp a control lever that pivots at or near the base of the hand. These designs do not offer adequate fixed support for the operator and may cause sudden inadvertent movement of the equipment.

With the split grip control lever according to the present invention, inadvertent motion caused by inertia shifts in the operator's environment can be substantially eliminated. The grip includes a movable control portion that is operated by the thumb and index finger and a fixed portion that serves to support the operator's hand. This construction enables the operator to let go of the top movable portion of the control lever while maintaining a firm grasp of the fixed base portion of the grip.

In an exemplary embodiment of the invention, a split grip control lever includes a fixed base portion and a movable upper portion that is separately pivotable relative to the fixed base portion. The movable upper portion and the fixed base portion define a substantially continuous profile. The movable upper portion and the fixed based portion define structure for an operator to resist effects of all external forces via one hand while maintaining control of the movable upper portion with the same hand.

A control device is positioned within the fixed base portion, and the movable upper portion includes a control shaft coupled with the control device. Preferably, the control device is disposed at a substantially central position relative to the lever profile such that a pivot point of the control shaft is centrally disposed relative to the lever profile. In other words, the control device is disposed at a position spaced from a surface to which the fixed base portion is fixedly secured at a substantially central position relative to the lever profile. The control device may be an electromechanical control device or an optical control device.

The substantially continuous profile is preferably shaped to fit a user's hand. In this context, the profile may be configured for a user's right hand or a user's left hand. As noted above, the movable upper portion is disposed relative to the fixed base portion and sized for manipulation by a user's thumb and index finger, while the fixed base portion is disposed relative to the movable upper portion and sized to support the user's hand.

In another exemplary embodiment of the invention, a control lever for machinery includes a fixed base portion fixedly securable to a surface of the machinery such that the fixed base portion is immovable, and a control portion disposed adjacent the fixed base portion and movable relative to the fixed base portion. The control portion is separated from the fixed base portion via a split line and is contiguous with the fixed base portion to define a substantially continuous profile.

In yet another exemplary embodiment of the invention, a machine including a machine frame supporting at least one movable element is provided with the control lever of the present invention.

BRIEF DESCRIPTION OF THE DRAWINGS

These and other aspects and advantages of the present invention will be described in detail with reference to the accompanying drawings, in which:

FIG. 3 is a sectional view through the control lever control shaft.

DETAILED DESCRIPTION OF PREFERRED EMBODIMENTS

Figure 1:
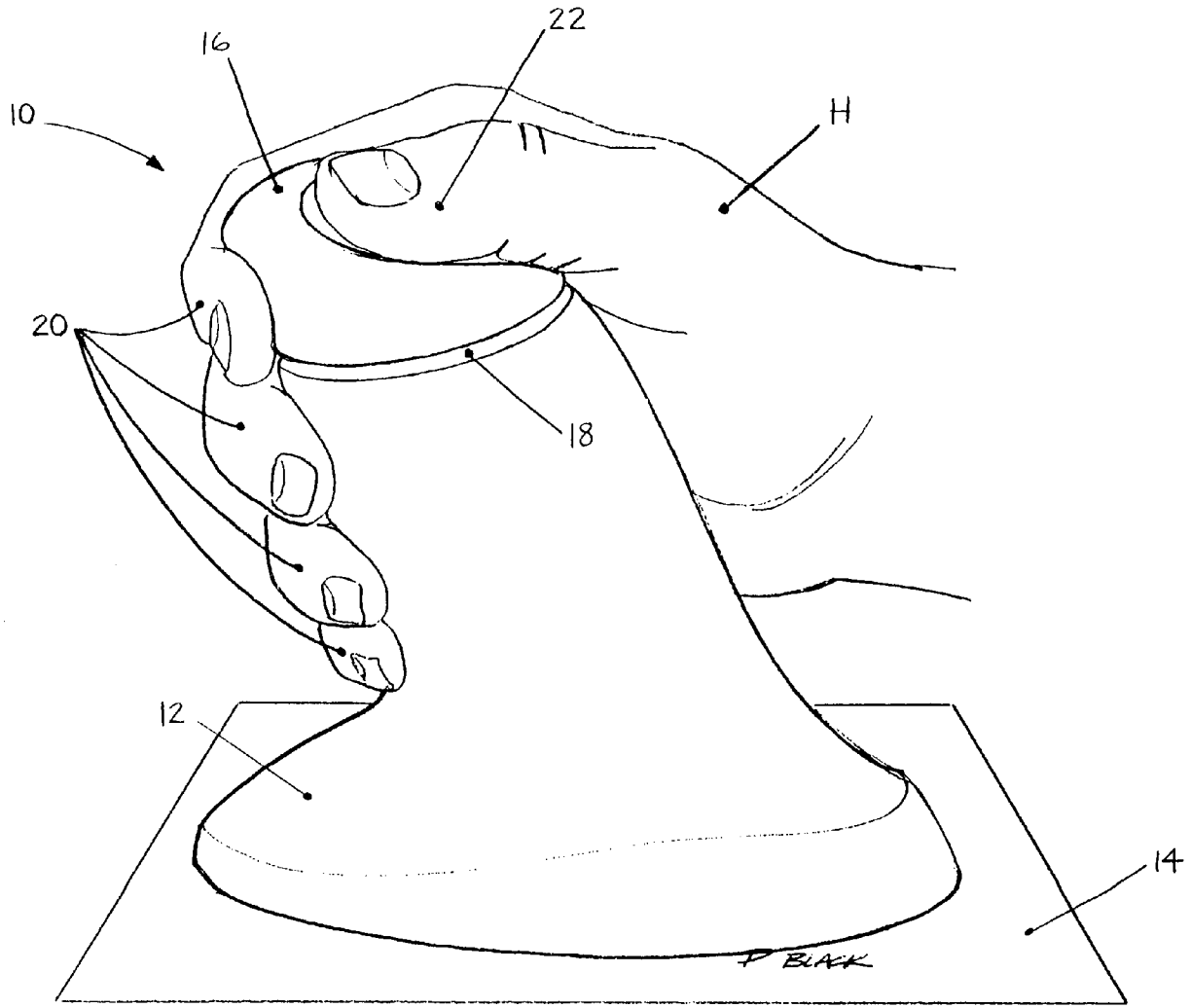
FIG. 1 is a perspective view of the split grip control lever according to the present invention.

As shown in FIG. 1, the split grip control lever 10 according to the present invention includes a fixed base portion 12 that is fixedly securable to a surface 14 such as a machine frame, control panel or the like, and a movable upper portion 16 defining a control portion of the lever that is movable relative to the fixed base portion 12. The movable upper portion 16 and the fixed base portion 12 are essentially contiguous but separated by a split line 18. With this construction, the movable upper portion 16 and the fixed base portion 12 together define a substantially continuous profile as shown in FIG. 1. By "substantially continuous profile," the upper portion 16 in a resting position appears contiguous with a top portion of the fixed base portion 12. To effect such a contiguous appearance, a perimeter of facing ends of the fixed based portion 12 and the movable upper portion 16 respectively on opposite sides of the split line 18 are substantially identical in size and shape. In this context, with reference to FIG. 3, the facing ends may be cooperatively shaped in three dimensions; e.g., FIG. 3 shows a top perimeter of the fixed base portion 12 slightly curved and the facing perimeter of the movable upper portion 16 correspondingly curved.

The continuous profile is preferably shaped to fit a user's hand H and includes finger grip portions 20 and a thumb grip portion 22. The grip shown in FIG. 1 is configured for right hand operation, although an advantageous embodiment of the invention enables the profile to be configured for left hand operation or custom configured for a particular user's hand size or the like. The grip is preferably formed of a suitable engineered plastic, although other suitably formable materials may be used. As shown, the movable upper portion 16 is disposed relative to the fixed base portion 12 and sized for manipulation by an operator's thumb and index finger, while the fixed base portion 12 is disposed relative to the movable upper portion 16 and sized to support the operator's hand.

Figure 2:
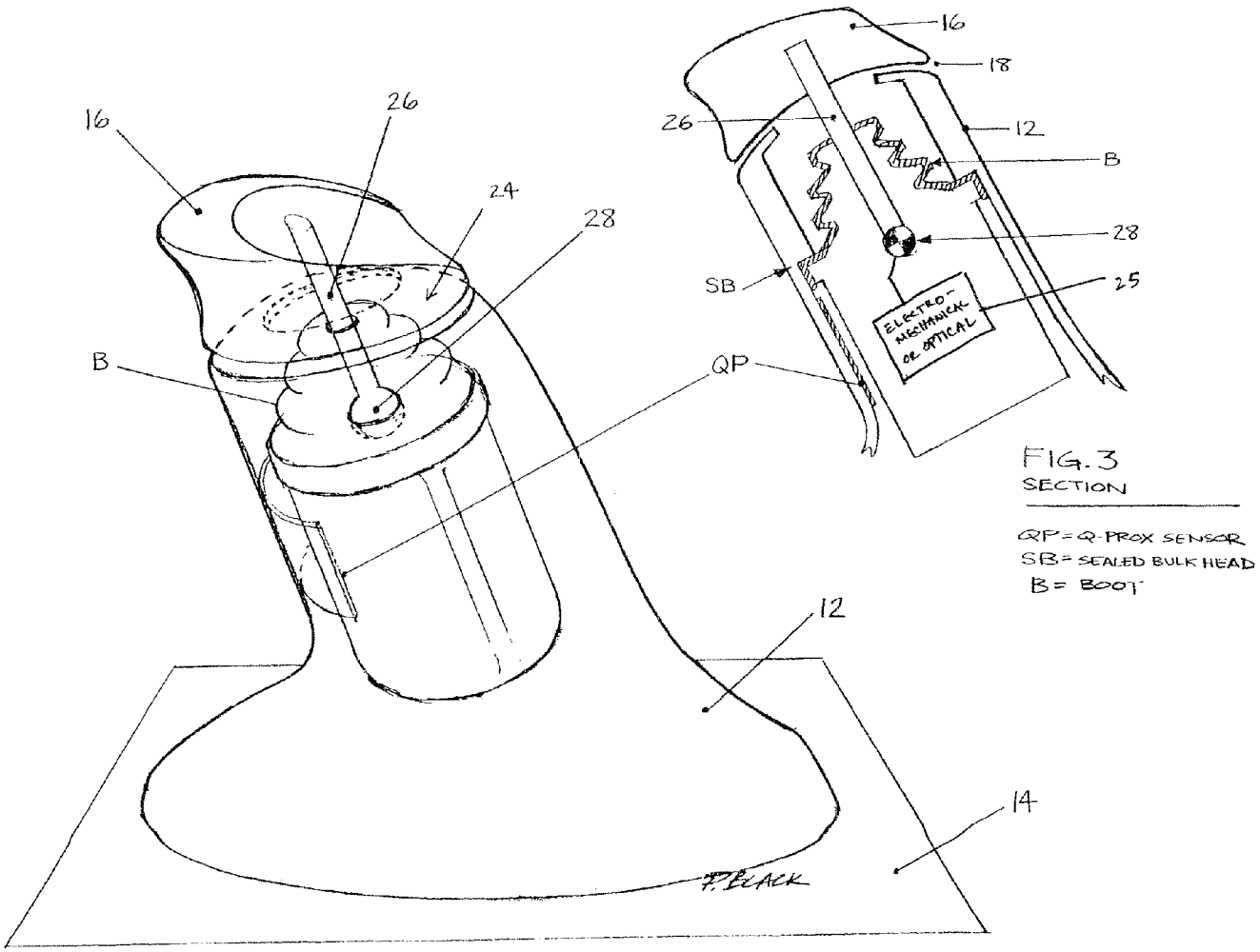
FIG. 2 is an internal schematic illustration of the split grip control lever shown in FIG. 1.

FIG. 2 is a schematic illustration of the operating components within the split grip control lever according to the invention, and FIG. 3 is a sectional view through the lever. Any suitable multi-position pivoting control switch, such as an electromechanical or optical control switch 25, can be implemented into the split grip control lever according to the invention, and a detailed description of the control components is omitted. That is, any known system that generates a control signal based on movement of a control lever to effect machine operation could be used.

According to the invention, however, a control device 24 is preferably positioned within the fixed base portion 12 as shown in FIG. 2, and the movable upper portion 16 includes a control shaft 26 coupled with the control device 24 at a substantially central position relative to the lever profile such that a pivot point 28 of the control shaft 26 is centrally disposed relative to the lever profile. That is, with the fixed base portion 12 secured to a machine frame, surface or the like 14, the control device 24 is disposed at a position spaced from the surface 14 at a substantially central position relative to the lever profile. Such positioning allows for a short control shaft 26 which pivots at or near the center of the unit. By this arrangement, finite control of the equipment is readily effected, which contrasts many existing control lever designs that require longer movements of the control lever to maintain proportional movement of the equipment. The control device 24 also includes a boot 30 that protects the control device components and a sealed bulkhead 32 that helps secure the control device 24 and seal the boot 30.

The lever may additionally be provided with a capacitance proximity sensor 34, such as the QProx QT sensor available from Quantam Research Group in the United Kingdom, which detects the presence of a human hand and only activates the lever upon such a detection. The sensor 34 thus serves to prevent inadvertent activation of machine components. A control lever incorporating a capacitance sensor is described in commonly-owned U.S. Pat. No. 6,501,198, the contents of which are hereby incorporated by reference. Alternatively, the lever may be provided with a conventional mechanical safety trigger lock or the like.

With the construction of the present split grip control lever, the ergonomic shape of the lever as it relates to various hand sizes, right and left hand specific orientation, etc., contributes to the effectiveness of the design. The arrangement invites the operator's hand to a relaxed position and allows for full movement of the controls with minimal stress or fatigue to the hand. As a consequence, the overall feel of the control is optimized while enabling an operator to avoid inadvertent movement and actuation of machine components by grasping the fixed base portion. Additionally, the fixed base portion in use is secured so as to be immovable, and with the movable upper portion defines structure for an operator to resist the effects of all external forces via one hand while advantageously maintaining control of the movable upper portion with the same hand.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A split grip control lever fixedly secured to a surface, the split grip control lever comprising:

a fixed base portion that is immovable relative to the surface;

a movable upper portion that is separately pivotable relative to the fixed base portion, wherein a perimeter of facing ends of the movable upper portion and the fixed base portion are substantially identical in size and shape to define a substantially continous profile; and the fixed base portion comprises means for an operator to resist effects of all external forces via one hand while maintaining control of the movable upper portion with said one hand.

2. A split grip control lever according to claim 1, further comprising a control device positioned within the fixed base portion, wherein the movable upper portion comprises a control shaft coupled with the control device.

3. A split grip control lever according to claim 2, wherein the control device is disposed at a central position relative to the substantially continuous profile such that a pivot point of the control shaft is centrally disposed relative to the substantially continuous profile.

4. A split grip control lever according to claim 2, wherein the control device is disposed at a position spaced from the surface at a central position relative to the substantially continuous profile.

5. A split grip control lever according to claim 2, wherein the control device is an electromechanical control device.

6. A split grip control lever according to claim 2, wherein the control device is an optical control device.

7. A split grip control lever according to claim 1, wherein a shape of the substantially continuous profile is configured to fit an operator's hand.

8. A split grip control lever according to claim 7, wherein the shape of the substantially continuous profile is configured to fit one of an operator's right hand or left hand.

9. A split grip control lever according to claim 1, wherein the movable upper portion is disposed relative to the fixed base portion and sized for manipulation by a operator's thumb and index finger, and wherein the fixed base portion is disposed relative to the movable upper portion and sized to support the operator's hand.

10. A split grip control lever according to claim 1, wherein the movable upper portion and the fixed base portion define an ergonomic profile.

11. Machinery including a control lever, the control lever comprising:

a fixed base portion fixedly secured to a surface of the machinery such that the fixed base portion is immovable;

a control portion disposed adjacent the fixed base portion and movable relative to the fixed base portion, the control portion being separated from the fixed base portion via a split line and being contiguous with the fixed base portion such that a perimeter of facing ends of the control portion and the fixed portion are substantially identical in size and shape to define a substantially continuous profile; and the fixed base portion comprises means for an operator to resist effects of all external forces via one hand while maintaining control of the control portion with said one hand.

12. Machinery according to claim 11, wherein the control lever further comprises a control device positioned within the fixed base portion, wherein the control portion comprises a control shaft coupled with the control device.

13. Machinery according to claim 12, wherein the control device is disposed at a central position relative to the lever profile such that a pivot point of the control shaft is centrally disposed relative to the lever profile.

14. Machinery according to claim 12, wherein the control device is disposed at a position spaced from the surface at a central position relative to the lever profile.

15. Machinery according to claim 11, wherein the control portion and the fixed base portion define an ergonomic profile.

16. A machine comprising:

a machine frame supporting at least one movable element; and a control lever secured to the machine frame, the control lever comprising:

a fixed base portion fixedly secured to the machine frame such that the fixed base portion is immovable, the fixed base portion providing support for an operator to resist effects of all external movements resulting from movement of the machine, and a movable upper portion that is separately pivotable relative to the fixed base portion for controlling movement of the at least one movable element, wherein a perimeter of facing ends of the movable upper portion and the fixed base portion are substantially identical in size and shape to define a substantially continuous profile.

17. A machine according to claim 16, wherein the control lever further comprises a control device positioned within the fixed base portion, and wherein the movable upper portion comprises a control shaft coupled with the control device.

18. A machine according to claim 17, wherein the control device is disposed at a central position relative to the lever profile such that a pivot point of the control shaft is centrally disposed relative to the lever profile.

19. A machine according to claim 17, wherein the control device is disposed at a position spaced from the machine frame at a central position relative to the lever profile.

* * * * *